United States Patent [19]

Olsen

[11] Patent Number: 4,678,354

[45] Date of Patent: Jul. 7, 1987

[54] TYPEWRITER CABLE TENSIONING MECHANISM

[75] Inventor: Alf J. Olsen, Elk Grove Village, Ill.

[73] Assignee: Xerox Corporation, Stamford, Conn.

[21] Appl. No.: 803,686

[22] Filed: Dec. 2, 1985

[51] Int. Cl.[4] ..... B41J 19/56

[52] U.S. Cl. ..... 400/335; 400/320; 400/54; 474/113; 474/117

[58] Field of Search ..... 400/320, 322, 328, 335, 400/54, 340; 74/10.7, 89.22; 474/138, 117, 115, 101-102, 113

[56] References Cited

U.S. PATENT DOCUMENTS

| | | | |
|---|---|---|---|
| 2,612,988 | 10/1952 | Andrews | 198/208 |
| 3,532,204 | 10/1970 | Sasaki | 400/320 |
| 3,885,661 | 5/1975 | Okabe | 400/320 |
| 4,116,568 | 9/1978 | Suzuki et al. | 400/320 |
| 4,203,680 | 5/1980 | Mitrovich | 400/320 |
| 4,208,141 | 6/1980 | Jagger | 400/320 X |
| 4,395,145 | 7/1983 | Giacone et al. | 400/320 X |
| 4,395,151 | 7/1983 | Krenz | 400/320 |
| 4,403,877 | 12/1983 | Jones et al. | 400/335 |
| 4,484,485 | 11/1984 | Matsuhisa | 400/322 X |

FOREIGN PATENT DOCUMENTS

| | | | |
|---|---|---|---|
| 3319671 | 12/1984 | Fed. Rep. of Germany | 400/335 |
| 30881 | 3/1981 | Japan | 400/322 |
| 169386 | 10/1982 | Japan | 400/320 |
| 158277 | 9/1984 | Japan | 400/328 |
| 1173230 | 12/1969 | United Kingdom | 400/335 |
| 2152180 | 7/1985 | United Kingdom | 400/322 |

OTHER PUBLICATIONS

"Belt Tensioner", IBM Tech. Discl. Bulletin, vol. 28, No. 7, Dec. 1985, pp. 2986-2987.

*Primary Examiner*—E. H. Eickholt

*Attorney, Agent, or Firm*—Robert E. Cunha

[57] ABSTRACT

A typewriter carriage cable snubber which is automatically reset at the time power is turned on is described. The cable is normally tensioned by a mechanism which is spring driven to maintain the cable tension at the proper value, and a snubber is provided to prevent the positioner from allowing the cable path to shorten under the increased tension that occurs during carriage acceleration. When the power is turned off, the cable tends to shrink due to the decreased temperature. When power is turned on, the carriage is initialized by positioning it at the left end of its range. At this position the cable tensioning mechanism can be reset to allow a shorter cable length by having an extension of the carriage disengage the snubber, allowing the positioning mechanism to reset itself to a shorter cable length.

4 Claims, 3 Drawing Figures

TYPEWRITER CABLE TENSIONING MECHANISM

BACKGROUND OF THE INVENTION

This is a cable tensioning mechanism and more specifically is a mechanism which tensions the cable of a typewriter during use and automatically resets the tensioner when the power is turned on.

The function of a cable snubber mechanism is to control momentary cable slack caused by carriage acceleration and deceleration forces acting on the cable. Cable slack, if allowed to occur, reduces the maximum speed at which the carriage can be incrementally positioned and also reduces the positional accuracy of each incremental carriage position.

Various automatic tensioning devices are in common use for tensioning driving means such as cables, chains, belts, etc. The most common case is that wear and age stretch the driving means, and an automatic snubbing mechanism is required to maintain the slack in the system to a predetermined optimum level.

There is, however, a class of mechanisms in which this automatic tensioning system is not the optimum solution. That is where the length of the driving means is a function not only of age and wear but also of the temperature of the cable. An example of this is in a typewriter, where the internal temperature slowly increases during the day, and drops overnight when the typewriter is not in use. Since the length of the cable is affected by the internal temperature of the typewriter, if the cable is properly tensioned at the end of the day, it will be overly tensioned when the typewriter is first turned on in the morning. A major parameter determining the operational life of cable wrapped around small pulleys is cable tension. Operating the cable at too great a tension exceeds the cable tensile strength limits, reducing its useful life. What is required is a cost effective method of controlling the cable tensioning mechanism to compensate for temperature.

SUMMARY OF THE INVENTION

In the described embodiment, the cable is wrapped around a pulley, the shaft of which is free to travel in a direction which will make the cable path longer or shorter. A first spring is urged against the shaft to drive the shaft in the direction that would make the cable path longer, tensioning the cable to a predetermined value.

Under stress, as when the carriage is accelerated, the tension in the cable is increased, but proper operation of the system will result only if the pulley shaft position does not react to this increased force by shortening the cable path. To prevent this, a cam or wedge driven by a second spring is wedged against the shaft to hold the shaft's position during periods of high cable tension. The system thus sets the resting, or minimum, tension of the cable, and can increase, but not decrease, the length of the cable path.

As indicated above, the cable normally shortens a bit when the typewriter is turned off overnight, and although the cable is not damaged by being left in that condition for a period of time, it is damaged by being used at greater than normal tensions. Therefore, to preserve cable life, this invention provides a means of resetting the cable path to a shorter value when the typewriter power is turned on.

The described embodiment has a mechanical stop designed into the carriage which contacts a lever connected to the wedge when the carriage is positioned at a predetermined position. The lever pulls the wedge away from the pulley shaft, allowing the cable tension to be determined by the biasing force of the first spring. Thus, in this one situation, the cable path is allowed to become shorter. Since this situation exists only when the power is first turned on, it would be optimal if this resetting takes place at a carriage position which occurs only when the power is turned on. One solution is to design the system so that this resetting occurs when the carriage is at the extreme left edge of its range since this is a position that usually only occurs during the initialization process at the time the power is turned on.

The invention will be more clearly understood in connection with the following drawings.

Figure 1:
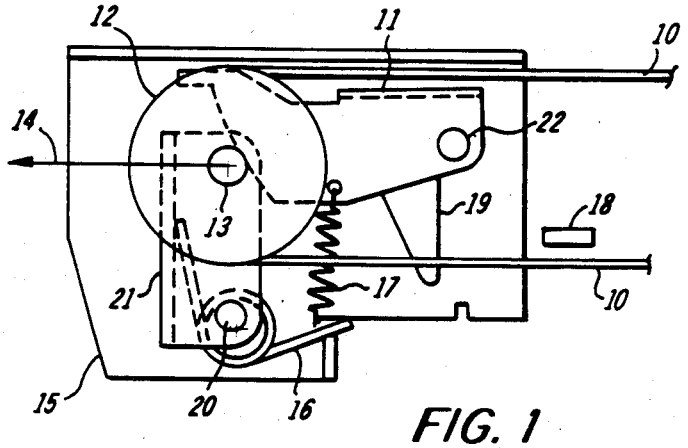
FIG. 1 shows the mechanism with the cable length set to mid-range.

FIG. 1 shows the mechanism as it would appear under normal operation, with the cable length set to the middle of its range. The cable 10 which drives the carriage wraps around pulley 12. The pulley 12 rotates around shaft 13 which is attached to a moveable bracket 21 which rotates about shaft 20 which, in turn, is solidly mounted to the stationary part of the typewriter chassis by means of bracket 15. The right end of the spring 16 is restrained by the bracket 15 and the middle by the shaft 20, thus producing a force in the direction of arrow 14, biasing the bracket 15 in a counterclockwise direction about shaft 20. The bracket 15 will rotate counterclockwise until the cable 10 tension offsets the spring 16 force. At this point the cable is properly tensioned.

To maintain the bracket 21 and pulley 12 in this position during short periods of high tension, as during carriage acceleration snubber cam 11 is pulled down into contact with the shaft 13, inhibiting the shaft from moving to the right.

Figure 2:
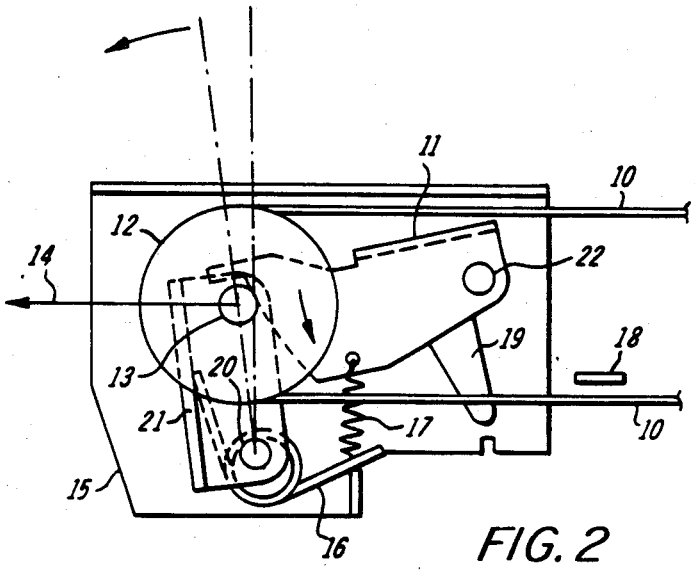
FIG. 2 shows the mechanism with the cable length extended to a longer setting.

As the cable warms up during use, or as the cable ages, it tends to lengthen. The mechanism compensates for this by lengthening the cable path to maintain the same cable tension, as shown in FIG. 2.

As the cable becomes longer, the tension decreases. The tension in the cable no longer offsets the force generated by spring 16, and bracket 21 rotates counterclockwise a small amount, increasing the cable tension back up to its proper value. Then spring 17 pulls snubber 11 down into contact with shaft 13 to lock the bracket 21 into its new position.

Figure 3:
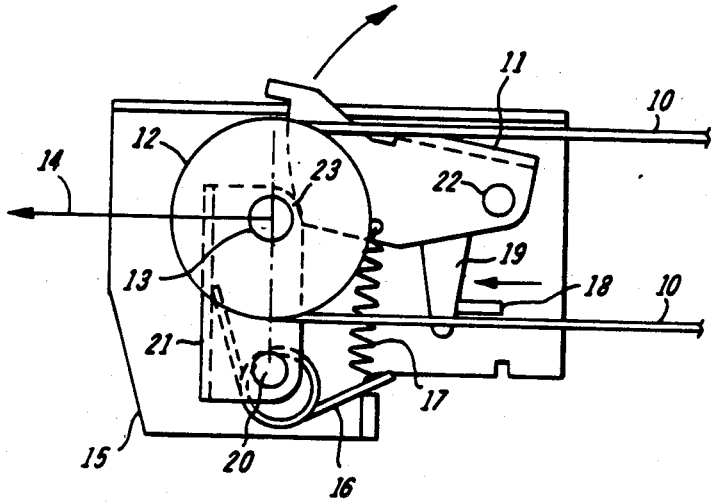
FIG. 3 shows the mechanism being reset to a shorter setting.

When the typewriter is first powered on, the mechanism will disengage the snubber to allow the spring 16 to reset the cable path to any length, including a length shorter than what it had been previously. This is accomplished by the mechanism as shown in FIG. 3.

When the typewriter is turned on, the lateral position of the carriage and the angular position of the print wheel are not known to the typewriter central processor. Therefore the first step is to initialize these two functions.. Carriage initialization consists of driving the carriage to the extreme left end of its range, then back to the right a short predetermined distance and then setting the carriage position counter to zero. The carriage counter position zero is the maximum left printing position of the carriage.

The typewriter is arranged so that the mechanism is located at the left end of the platen, and so that when the carriage is positioned to the left of counter position zero, a carriage extension 18 will contact the lever 19, driving the snubber 11 a few degrees in a clockwise direction about its shaft 22, creating a gap 23 between the pulley shaft 13 and the snubber 11. In this situation, the spring 16 drives the bracket 21 to an angular position where the cable tension just offsets the spring 16 force. At this point, if the cable has shortened due to having cooled during the time the typewriter has been turned off, the cable path will have been shortened accordingly. Then, as the carriage is spaced to the right to its normal left margin position, the carriage extension 18 is disengaged from the snubber lever 19, allowing the mechanism to return to its normal mode of operation as shown in FIGS. 1 and 2.

The mounting bracket 15 can be adjusted to the right and left. Therefore, when the cable is new, and therefore relatively short, the bracket 15 can be set to position the snubber 11 contact point with the pulley shaft 13 at a point below the midpoint of the snubber 11 cammed surface. This maximizes the amount of adjustment that can be made during the life of the cable.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. In a typewriter comprising a platen and a carriage which has a range of motion from the left end to the right end of the platen, a tensioning mechanism for maintaining a typewriter carriage cable at a predetermined tension comprising:

a pulley around which the cable is wrapped, first means for biasing the pulley against the cable to achieve said predetermined cable tension, a snubber preventing the pulley from moving in a direction that would result in a decreased cable tension, and means for disengaging the snubber from the pulley when the carriage is at one end of its range of motion to allow the cable tension to be decreased if it is greater than the predetermined tension.

2. In a typewriter comprising a platen and a carriage which has a range of motion from the left end to the right end of the platen, a tensioning mechanism for maintaining a typewriter carriage cable at a predetermined tension comprising:

a pulley around which the cable is wrapped, first means for biasing the pulley against the cable to achieve said predetermined cable tension, a snubber for preventing the pulley from moving in a direction that would result in a decreased cable tension, means for disengaging the snubber from the pulley when the carriage is at one end of its range to allow the cable tension to be decreased if it is greater than the predetermined tension, and wherein the means for disengaging comprises, an extension of the snubber, which contacts the carriage when the carriage is at one end of its range to disengage said snubber from said pulley, and a second means for biasing which biases the snubber into a mechanical coupling with the pulley at all other times.

3. In a typewriter comprising a power switch for turning on the power to the typewriter, a platen and a carriage which has a range of motion from the left end to the right end of the platen, a tensioning mechanism for maintaining a typewriter carriage cable at a predetermined tension comprising:

A pulley around which the cable is wrapped, first means for biasing the pulley against the cable to achieve said predetermined cable tension, a snubber for preventing the pulley from moving in a direction that would result in a shorter cable path, and means for momentarily disengaging the snubber from the pulley when the power to the typewriter is turned on.

4. The mechanism of claim 3 further comprising a means for biasing said snubber against said pulley, and wherein said means for disengaging overcomes said bias while momentarily disengaging said snubber from said pulley.

* * * * *